US007893916B2

(12) United States Patent
Wei

(10) Patent No.: US 7,893,916 B2
(45) Date of Patent: Feb. 22, 2011

(54) LUMINANCE COMPENSATION DEVICE AND METHOD THEREOF FOR BACKLIGHT MODULE

(75) Inventor: Hsien-Wang Wei, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 861 days.

(21) Appl. No.: 11/779,520

(22) Filed: Jul. 18, 2007

(65) Prior Publication Data

US 2008/0252582 A1 Oct. 16, 2008

(30) Foreign Application Priority Data

Apr. 13, 2007 (TW) ..... 96112992 A

(51) Int. Cl.
*G09G 3/36* (2006.01)

(52) U.S. Cl. ..... 345/102; 345/82; 345/83; 345/76; 345/77; 345/207; 345/690; 345/697; 250/200; 250/552; 250/553; 315/169.3

(58) Field of Classification Search ..... 345/102, 345/82, 83, 76, 77, 207, 690, 697; 250/200, 250/552, 553; 315/169.3
See application file for complete search history.

(56) References Cited

U.S. PATENT DOCUMENTS 6,127,783 A 10/2000 Pashley et al.
6,344,641 B1 2/2002 Blalock et al.
6,441,558 B1 8/2002 Muthu et al.
6,448,550 B1 9/2002 Nishimura
6,495,964 B1 12/2002 Muthu et al.
6,611,249 B1 * 8/2003 Evanicky et al. ..... 345/102
6,753,661 B2 6/2004 Muthu et al.
6,894,442 B1 * 5/2005 Lim et al. ..... 315/291
7,002,546 B1 * 2/2006 Stuppi et al. ..... 345/102
7,030,574 B2 4/2006 Lim et al.
2002/0011978 A1 1/2002 Yamazaki et al. ..... 34/87
2006/0132424 A1 * 6/2006 Foo et al. ..... 345/102

FOREIGN PATENT DOCUMENTS

CN 1774665 A 5/2006

OTHER PUBLICATIONS

Chinese First Examination Report of China Application No. 2007101008443, dated on Jun. 19, 2009.

* cited by examiner

*Primary Examiner*—Alexander Eisen
*Assistant Examiner*—Priyank Shah
(74) *Attorney, Agent, or Firm*—J.C. Patents

(57) ABSTRACT

A luminance compensation device for a backlight module and a method thereof are provided herein. In the present invention, a light sensor unit is utilized to sense a light intensity of the backlight module. A difference parameter based on the sensed light intensity and a preset luminance is calculated. Then, a gamma curve, a video data, or light intensity of the backlight module is adjusted according to the difference parameter. As a result, the level of display quality affected by the temperature or the aging of the backlight module can be reduced.

14 Claims, 5 Drawing Sheets

LUMINANCE COMPENSATION DEVICE AND METHOD THEREOF FOR BACKLIGHT MODULE

CROSS-REFERENCE TO RELATED APPLICATION

This application claims the priority benefit of Taiwan application serial no. 96112992, filed on Apr. 13, 2007. All disclosure of the Taiwan application is incorporated herein by reference.

BACKGROUND OF THE INVENTION

1. Field of the Invention

The present invention relates to a luminance compensation device, and more particularly, to a luminance compensation device utilizing a photosensitive technology to compensate for the luminance of a backlight module.

2. Description of Related Art

As technology advances, liquid crystal displays (LCDs) are becoming more and more popular. However, LCDs age over a period of time, especially the backlight module of a LCD. In some backlight modules, the primary light source used consists of light emitting diodes (LEDs). The light intensity of the light emitted by LEDs varies according to the device temperature and the degree of aging of the device. Since the backlight module ages over time, in order for a liquid crystal display to display consistent luminance and colors, the luminance and the colors of the backlight module need to be compensated.

FIG. 1 is a schematic view illustrating a conventional luminance compensation device for a backlight module. Please refer to FIG. 1. The backlight module includes a power converter 10, a backlight driving unit 20, a light emitting diode 30, a light sensor unit 40 and a control unit 50. Herein, the power supply converter 10 is used to provide the voltage required by the backlight driving unit 20. The backlight driving unit 20 is used to provide the voltage and the current required by the light emitting diode 30. The light emitting diode 30 generates corresponding light intensity according to the voltage and the current provided. Next, the light sensor unit 40 is used to sense the light intensity of the light emitted by the light emitting diode 30 and transmits a detection signal to the control unit 50. The control unit 50 adjusts the backlight driving unit 20 according to the detection signal in order to adjust the light emitting diode 30 by feedback control. Hence, luminance compensation for the backlight module is achieved.

Further, U.S. Pat. Nos. 6,127,783, 6,344,641, 6,441,558, 6,448,550, 6,495,964, and 6,894,442 also disclose a similar method as described above. It should be noted that the differences among U.S. Pat. Nos. 6,127,783, 6,344,641, 6,441,558, 6,448,550, 6,495,964, and 6,894,442 include the driving timing, the location where the light sensor unit 40 is disposed, and the type of light sensor unit used. Also, the method disclosed by U.S. Pat. Nos. 6,127,783, 6,344,641, 6,441,558, 6,448,550, 6,495,964, 6,894,442 utilizes the control unit 50 to control the light intensity of the light emitting diode 30 based on the light intensity sensed by the light sensor unit 40. Yet, additional costs are required to manufacture the control unit 50 and the adjustment that can be made to the light intensity of the light emitting diode 30 is rather limited.

Therefore, LCD manufacturers have been looking for suitable solutions to overcome the aforementioned problems.

SUMMARY OF THE INVENTION

The present invention is directed to a method for compensating the luminance of a backlight module by adjusting video data to compensate for luminance or color distortion resulted by the temperature or the aging of the light emitting diode in the backlight module.

The present invention is directed to a luminance compensation device for a backlight module that utilizes a light sensor unit to sense the light intensity of the backlight module in order to obtain the difference parameter for the light intensity of the backlight module and the preset luminance. Consequently, the video data is adjusted to improve the display quality.

The present invention is directed to a method for compensating the luminance of a backlight module that is adapted for use in a display device that displays video data. The method includes the following steps. First, the light intensity of a backlight module is sensed. A difference parameter based on the light intensity of the backlight module and the preset luminance is calculated. The video data is adjusted according to the calculated difference parameter.

In one embodiment of the present invention, the method further includes adjusting a gamma curve according to the difference parameter and this gamma curve is used to convert or map the luminance of the video data.

The present invention is also directed to another luminance compensation device for a backlight module that is adapted for use in a display device that displays video data and this device includes a light sensor unit, an arithmetic unit and a correction unit. The light sensor unit is used to sense the light intensity of the backlight module. The arithmetic unit is coupled to the light sensor unit. Further, the arithmetic unit is used to calculate the difference parameter based on the light intensity of the backlight module and the preset luminance. The correction unit is coupled to the arithmetic unit. Further, the arithmetic unit adjusts the gamma curve and/or the video data according to the difference parameter, and the gamma curve is used to convert or map the luminance of the video data.

In one embodiment of the present invention, the correction unit further includes a data mapping unit and a gamma mapping unit. The data mapping unit is coupled to the arithmetic unit and the video data is adjusted by the data mapping unit according to the difference parameter. The gamma mapping unit is coupled to the data mapping unit and the gamma curve is adjusted by the gamma mapping unit according to the difference parameter.

In one embodiment of the present invention, the light sensor unit further includes a sensor and a signal conversion unit. The sensor is used to sense the light intensity. The signal conversion unit is disposed between the arithmetic unit and the sensor by coupling and the signal conversion unit is used to convert an analog signal sensed by the sensor into a digital signal.

In the present invention, a light sensor unit is utilized to sense the light intensity of a backlight module. Next, a difference parameter based on the sensed light intensity and a preset luminance is calculated. Thereafter, the gamma curve and/or the video data is adjusted according to the difference parameter in order to compensate for the luminance distortion resulted by the temperature or the aging of the backlight module.

In order to make the aforementioned and other objects, features and advantages of the present invention more comprehensible, preferred embodiments accompanied with figures are described in detail below.

DESCRIPTION OF EMBODIMENTS

Figure 1:
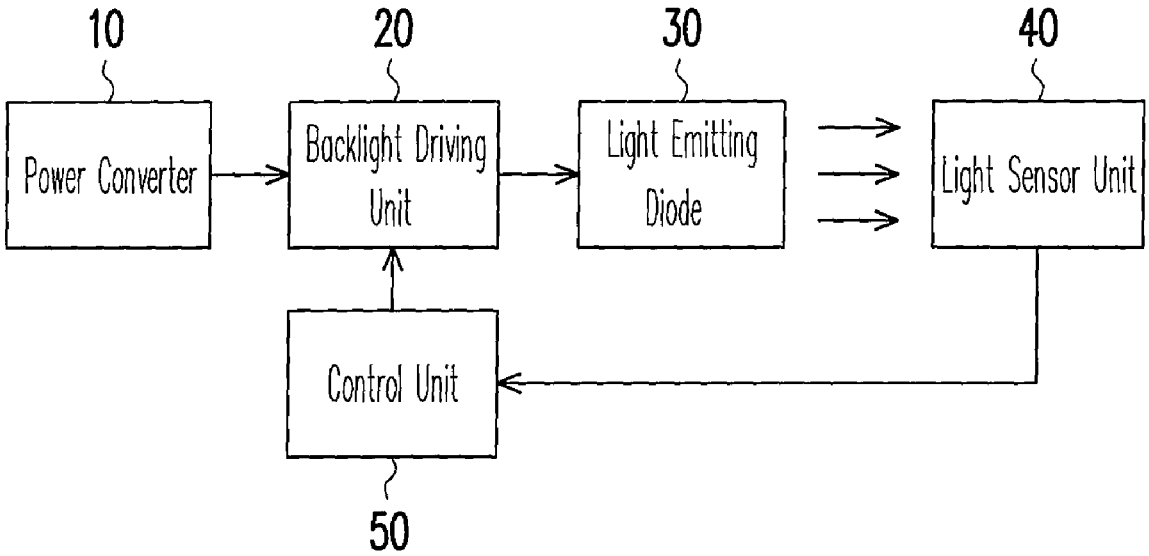
FIG. 1 is a schematic view illustrating a conventional luminance compensation device for a backlight module.
Figure 2A:
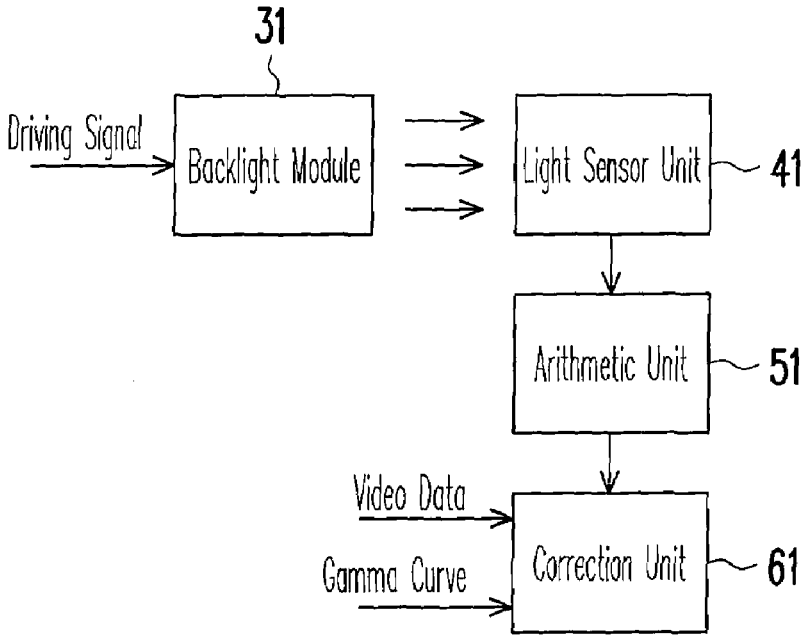
FIG. 2A is a schematic view illustrating a luminance compensation device for a backlight module according to the first embodiment of the present invention.
Figure 2B:
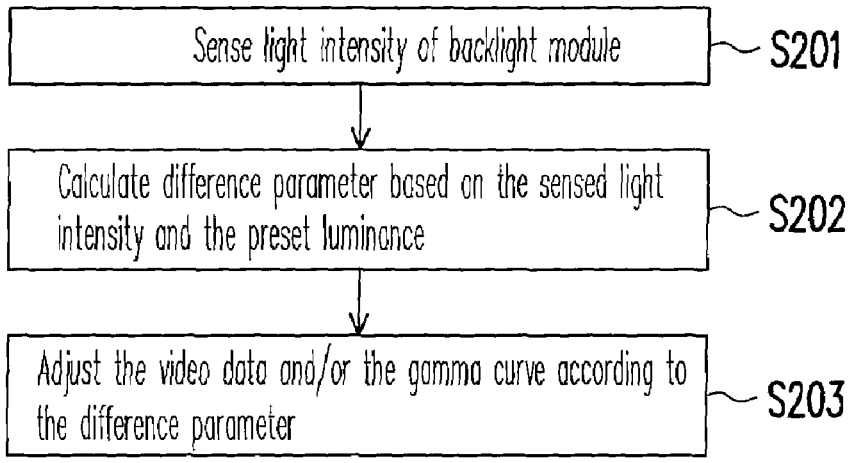
FIG. 2B is a schematic view illustrating a method for compensating the luminance for a backlight module according to the first embodiment of the present invention.

FIG. 2A is a schematic view illustrating a luminance compensation device for a backlight module according to the first embodiment of the present invention. FIG. 2B is a schematic view illustrating a method for compensating the luminance of a backlight module according to the first embodiment of the present invention. Please refer to FIG. 2A and FIG. 2B. The luminance compensation device including a light sensor unit 41, an arithmetic unit 51, and a correction unit 61 is adapted for compensating the luminance of a backlight module 31 in a display device. The backlight source of the backlight module 31 generates corresponding light according to the voltage and the current provided. Further, a Red/Green/Blue (RGB) LED is used as an example of a backlight source in a backlight module to illustrate the present embodiment. Those ordinarily skilled in the art should know that the RGB LED described in the present embodiment is merely a specific embodiment. In another embodiment, the backlight source of the backlight module 31 may be a cold cathode fluorescent lamp, a white LED in combination with a color filter to mix colors or other types of point light source, linear light source and planar light source. Therefore, the present invention is not limited thereto.

Next, in step S201, the light intensity of the backlight module 31 is sensed by the light sensor unit 41. Thereafter, in step S202, the difference parameter based on the light intensity and the preset luminance is calculated by the arithmetic unit 51. The preset luminance refers to the ideal light intensity outputted by the backlight module 31. Afterward, in step S203, the video data and/or the gamma curve is adjusted by the correction unit 61 according to the difference parameter. Herein, the gamma curve is used to convert or map the luminance of the video data. As a result, the luminance distortion resulted by the temperature or the aging of the backlight module 31 can be compensated and the color distortion can be reduced. In the present embodiment, the gamma curve is adjusted by the correction unit 61 according to the difference parameter. Those ordinarily skilled in the art can modify the implementation of the above embodiment as required. For example, a plurality of gamma curves can be pre-designated and a gamma curve is selected by the correction unit 61 according to the difference parameter.

Figure 3:
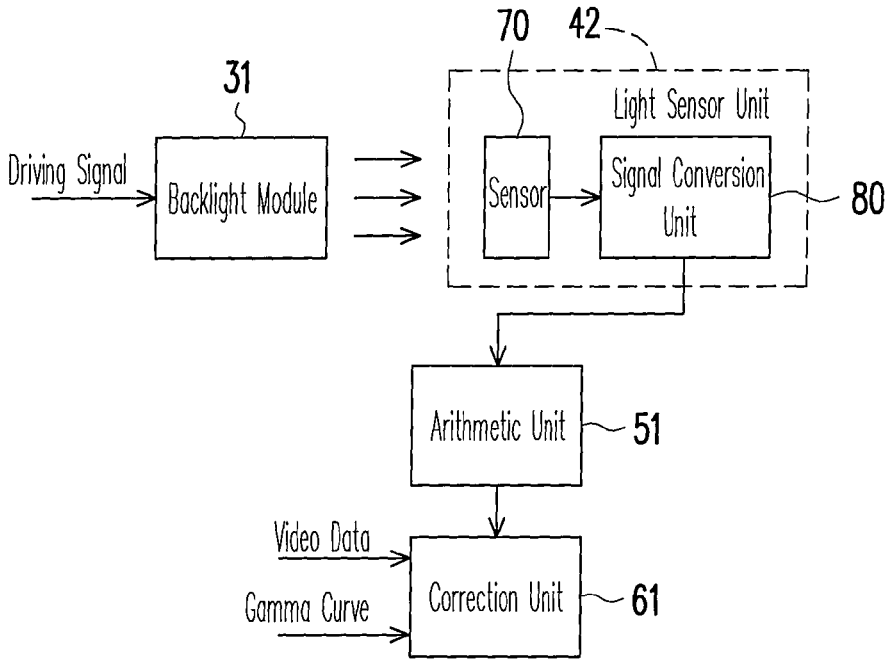
FIG. 3 is a schematic view illustrating a luminance compensation device for a backlight module according to the second embodiment of the present invention.

FIG. 3 is a schematic view illustrating a luminance compensation device for a backlight module according to the second embodiment of the present invention. Please refer to FIG. 3. In the present embodiment, the luminance compensation device includes a light sensor unit 42, an arithmetic unit 51 and a correction unit 61. Herein, the arithmetic unit 51 and the correction unit 61 are identical to those described in the above-mentioned embodiment. Hence, a detailed description thereof is omitted. However, the light sensor unit 42 should be noted. In the present embodiment, the light sensor unit 42 includes a sensor 70 and a signal conversion unit 80. The sensor 70 is used to sense the light intensity of the backlight module 31 and output electrical signals. In the present embodiment, the electrical signals outputted by the sensor 70 are analog signals such as voltage or current.

The sensor 70 may be configured differently in different embodiments. For example, the sensor 70 may be a photodiode, a color sensor or an ambient light sensor (ALS). In other words, the sensor 70 generally refers to a photosensitive device that can sense light.

The signal conversion unit is disposed between the arithmetic unit 51 and the sensor 70 by coupling. A serial peripheral interface (SPI) or an inter-integrated circuit (IIC) can be used to transfer data between the signal conversion unit 80 and the sensor 70. The signal conversion unit 80 is used to convert the electrical signals provided by the sensor 70. For example, in the present embodiment, an analog signal (e.g. voltage or current) provided by the sensor 70 is converted into a digital signal by the signal conversion unit 80. In addition, the sampling rate of the signal conversion unit 80 can be adjusted as required. Next, the digital signal is transmitted to the arithmetic unit 51 by the signal conversion unit 80. Thereafter, the difference parameter based on the digital signal and the preset luminance is calculated by the arithmetic unit 51, and the gamma curve and/or the video data is adjusted by the correction unit 61 according to the difference parameter. Consequently, the luminance distortion resulted by the temperature or the aging of the backlight module 31 can be compensated and the color distortion can be reduced.

In the above-mentioned embodiment, an analog signal is used as an example of an electrical signal outputted by the sensor 70. However, in other embodiments, a digital signal can be directly outputted by the sensor 70. Consequently, the digital signal can be directly provided by the sensor 70 to the arithmetic unit 51 for performing calculation. On the other hand, the signal conversion unit 80 does not merely convert analog signals into digital signals. In particular embodiments, the signal conversion unit 80 may also convert a voltage signal into a current signal or vice versa. Hence, those ordinarily skilled in the art can decide the types of signal conversion for the signal conversion unit 80 to perform as desired.

Figure 4:
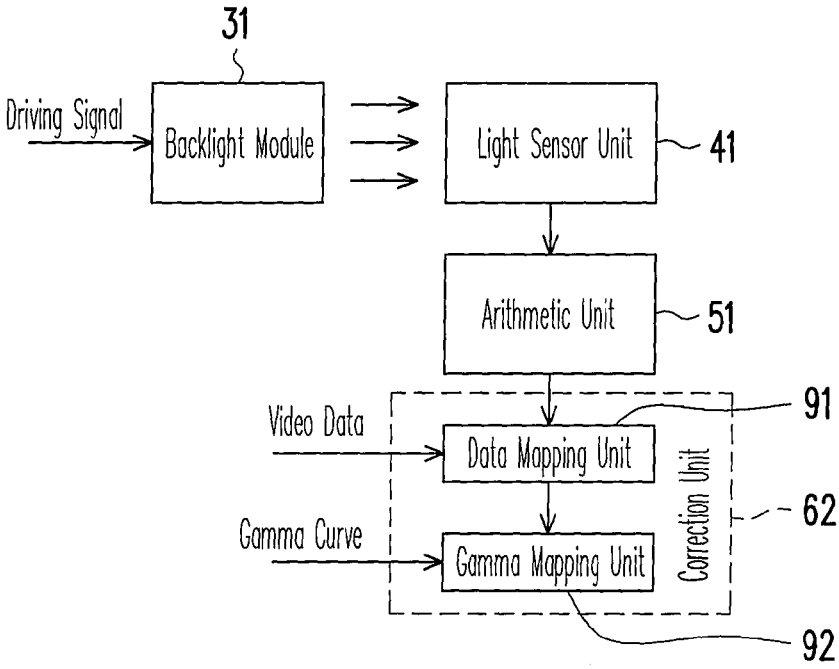
FIG. 4 is a schematic view illustrating a luminance compensation device for a backlight module according to the third embodiment of the present invention.

FIG. 4 is a schematic view illustrating a luminance compensation device for a backlight module according to the third embodiment of the present invention. Please refer to FIG. 4. In the present embodiment, the luminance compensation device includes a light sensor unit 41, an arithmetic unit 51 and a correction unit 62. Herein, the light sensor unit 41 and the arithmetic unit 51 are identical to those described in the above-mentioned embodiment. Hence, a detailed description thereof is omitted. However, the correction unit 62 should be noted. In the present embodiment, the correction unit 62 includes a data mapping unit 91 and a gamma mapping unit 92. The data mapping unit 91 is coupled to the arithmetic unit 51 and the video data is adjusted by the data mapping unit 91 according to the difference parameter calculated by the arithmetic unit 51. The data mapping unit 91 utilizes, for example, a digital-to-digital method to adjust video data. More specifically, the digital dynamic gamma curve can be provided to the data mapping unit 91 by the correction unit 62 based on the difference parameter. The luminance of video data is adjusted by the data mapping unit 91 using the gamma curve of the memory mapping.

The gamma mapping unit 92 is coupled to the data mapping unit 91. It should be noted that the gamma curve can be similarly adjusted by the gamma mapping unit 92 according to the difference parameter. More specifically, in the gamma mapping unit 92, for example, a plurality of gamma curves can be pre-designated and a different gamma curve can be selected according to the difference parameter in order to adjust the luminance of the video data. It should be noted that, in the present embodiment, both the data mapping unit 91 and the gamma mapping unit 92 can be simultaneously used to adjust the luminance of video data. However, in another embodiment, after the difference parameter calculated by the arithmetic unit 51 is received by the correction unit 62, either the data mapping unit 91 or the gamma mapping unit 92 can be used to adjust the video data. As a result, the luminance distortion resulted by the temperature or the aging of the backlight module 31 can be compensated, and the color distortion can be reduced.

Figure 5:
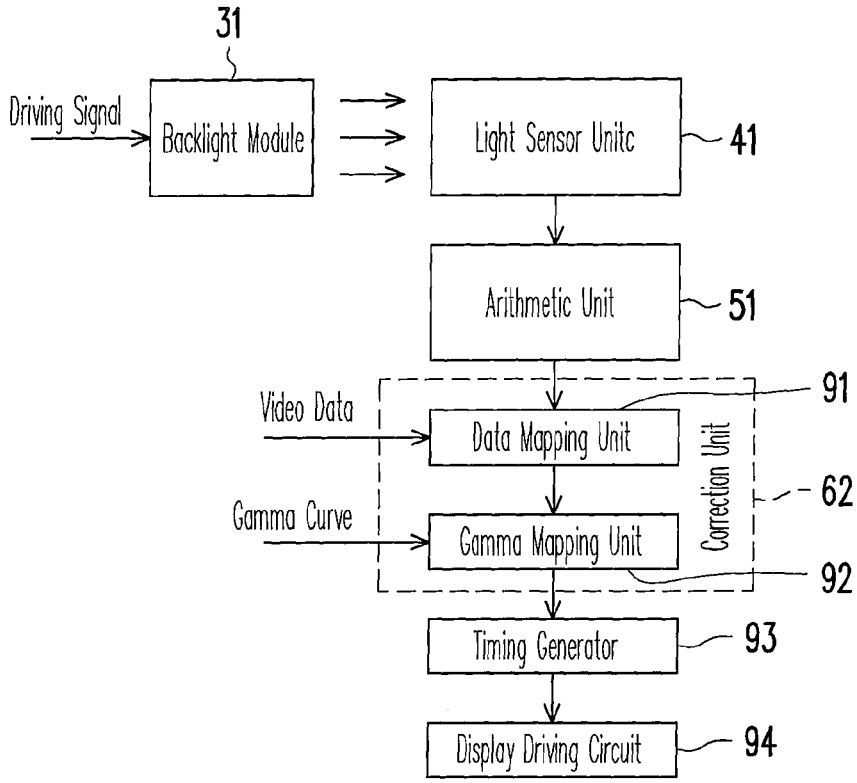
FIG. 5 is a schematic view illustrating a luminance compensation device for a backlight module according to the fourth embodiment of the present invention.

FIG. 5 is a schematic view illustrating a luminance compensation device for a backlight module according to the fourth embodiment of the present invention. Please refer to FIG. 5. A backlight module 31, a light sensor unit 41, an arithmetic unit 51, a correction unit 62, a data mapping unit 91 and a gamma mapping unit 92 in FIG. 5 are identical to those described in the above-mentioned embodiments. Hence, a detailed description thereof is omitted.

In the present embodiment, after the video data is adjusted by the correction unit 62, the adjusted video data is transmitted to a timing generator 93 by the correction unit 62. The timing generator 93 is used to generate the control signals and the data signals required by each driving circuit of the display device. In other words, the correction unit 62 is disposed prior to the timing generator 93. The timing generator 93 can output a control signal according to the adjusted video data. Further, the timing generator 93 provides the control signal and the adjusted video data to a display driving circuit 94. The display driving circuit 94 drives the display device to display the adjusted video data. Consequently, the luminance distortion of the backlight module 31 is compensated. In the present embodiment, the display driving circuit 94 generally refers to a source driver integrated circuit, a gate driver integrated circuit and the other related application circuit.

In view of the above, those ordinarily skill in the art can modify the implementation of the present invention and the teaching of the above embodiments as required. For example, according to another embodiment, the correction unit 62 can be disposed after the timing generator 93. In other words, the correction unit 62 is integrated into the display driving circuit 94. For example, the data mapping unit 91 is integrated into the source driving circuit. For another example, the gamma mapping unit 92 is integrated into the source driving circuit. It is advantageous to do so because no additional hardware structure is required, and existing display device structure can be used to compensate for the luminance and the color distortion resulted by the temperature or the aging of the backlight module 31, which considerably reduces the manufacturing costs.

Figure 6:
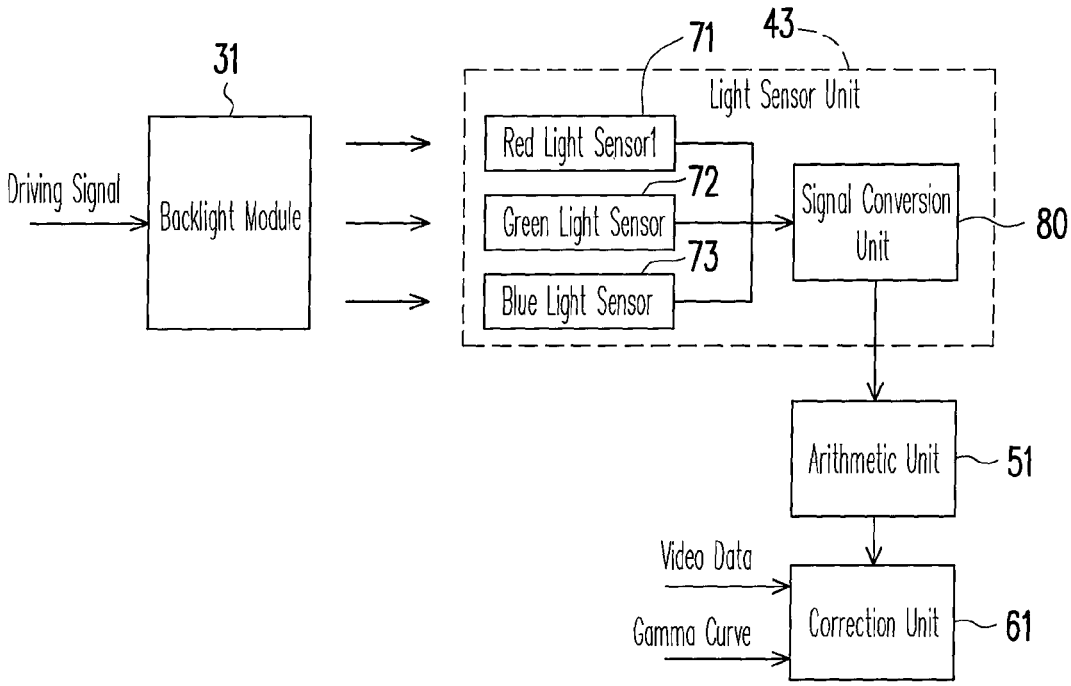
FIG. 6 is a schematic view illustrating a luminance compensation device for a backlight module according to the fifth embodiment of the present invention.

FIG. 6 is a schematic view illustrating a luminance compensation device for a backlight module according to the fifth embodiment of the present invention. Please refer to FIG. 6. In the present embodiment, the luminance compensation device includes a light sensor unit 43, an arithmetic unit 51 and a correction unit 61. The light sensor unit 43 includes a red light sensor 71, a green light sensor 72, a blue light sensor 73, and a signal conversion unit 80. Herein, the arithmetic unit 51, the correction unit 61, and the signal conversion unit 80 are identical to those described in the above-mentioned embodiment. Hence, a detailed description thereof is omitted. However, the red light sensor 71, the green light sensor 72, the blue light sensor 73 should be noted. The red light sensor 71 is used to sense primarily the light intensity of red light emitted by the backlight module 31 and output the light intensity of red light to the arithmetic unit 51 through the signal conversion unit 80. The green light sensor 72 is used to sense primarily the light intensity of green light emitted by the backlight module 31 and output the light intensity of green light to the arithmetic unit 51 through the signal conversion unit 80. The blue light sensor 73 is used to sense primarily the light intensity of blue light emitted by the backlight module 31 and output the light intensity of blue light to the arithmetic unit 51 through the signal conversion unit 80.

In view of the above, formula (3) can be obtained using formulae (1) and (2). The difference parameters for the red light, the green light and the blue light are calculated by the arithmetic unit 51 using formula (3). Formulae (1) through (3) are described in Table 1 below.

TABLE 1

| Description for Formulae (1)~(3) | |
|---|---|
| V(R), V(G), V(B), | The predetermined light intensity of red light sensed by the red light sensor 71, the predetermined light intensity of green light sensed by the green light sensor 72, and the predetermined light intensity of blue light sensed by the blue light sensor 73. |
| V(R), V(G), V(B), | The light intensity of red light sensed by the red light sensor 71, the light intensity of green light sensed by the green light sensor 72, and the light intensity of blue light sensed by the blue light sensor 73 after factors such as aging or changes in temperature take place. |
| $V_{rr}$, $V_{gr}$, Vbr | When a fixed driving current is continuously driving the red LED, the light intensity of red light sensed by the red light sensor 71, the light intensity of green light sensed by the green light sensor 72, and the light intensity of blue light sensed by the blue light sensor 73. |

TABLE 1-continued

| Description for Formulae (1)~(3) | |
|---|---|
| $V_{rg}$, $V_{gg}$, $V_{bg}$ | When a fixed driving current is continuously driving the green LED, the light intensity of red light sensed by the red light sensor 71, the light intensity of green light sensed by the green light sensor 72, and the light intensity of blue light sensed by the blue light sensor 73. |
| $V_{rb}$, $V_{gb}$, $V_{bb}$ | When a fixed driving current is continuously driving the blue LED, the light intensity of red light sensed by the red light sensor 71, the light intensity of green light sensed by the green light sensor 72, and the light intensity of blue light sensed by the blue light sensor 73. |
| $V_{r_dark}$, $V_{g_dark}$, $V_{b_dark}$ | When the red LED, the green LED, and the blue LED are all turned off, the light intensity of red light sensed by the red light sensor 71, the light intensity of green light sensed by the green light sensor 72, and the light intensity of blue light sensed by the blue light sensor 73. |
| PWM(R) | The predetermined time for lighting the red LED/The predetermined period for lighting the red LED |
| PWM(G) | The predetermined time for lighting the green LED/The predetermined period for lighting the green LED |
| PWM(B) | The predetermined time for lighting the blue LED/The predetermined period for lighting the blue LED |
| S1 | Difference parameter for red light |
| S2 | Difference parameter for green light |
| S3 | Difference parameter for blue light |

$$V(R)=(V_{rr}-V_{r_dark})*PWM(R)+(V_{rg}-V_{r_dark})*PWM(G)+(V_{rb}-V_{r_dark})*PWM(B)+V_{r_dark}$$

$$V(G)=(V_{gr}-V_{g_dark})*PWM(R)+(V_{gg}-V_{g_dark})*PWM(G)+(V_{gb}-V_{g_dark})*PWM(B)+V_{g_dark}$$

$$V(B)=(V_{br}-V_{b_dark})*PWM(R)+(V_{bg}-V_{b_dark})*PWM(G)+(V_{bb}-V_{b_dark})*PWM(B)+V_{b_dark} \quad \text{Formula 1}$$

$$V_m(R)=S_1(V_{rr}-V_{r_dark})*PWM(R)+S_2(V_{rg}-V_{r_dark})*PWM(G)+S_3(V_{rb}-V_{r_dark})*PWM(B)+V_{r_dark}$$

$$V_m(R)=S_1(V_{gr}-V_{g_dark})*PWM(R)+S_2(V_{gg}-V_{g_dark})*PWM(G)+S_3(V_{gb}-V_{g_dark})*PWM(B)+V_{g_dark}$$

$$V_m(R)=S_1(V_{br}-V_{b_dark})*PWM(R)+S_2(V_{bg}-V_{b_dark})*PWM(G)+S_3(V_{bb}-V_{b_dark})*PWM(B)+V_{b_dark} \quad \text{Formula 2}$$

Next, the red gamma, the green gamma and the blue gamma or the video data are adjusted correspondingly by the correction unit 61 according to the difference parameters for red light, green light and blue light in order to compensate for the luminance distortion and the color distortion resulted by the temperature or the aging of the backlight module 31.

Those ordinarily skilled in the art may modify the color or the quantity of the sensors taught by the present invention and the teaching of the above embodiments. Further, the formula for calculating the difference parameter for each color should be adjusted accordingly to compensate for the luminance distortion and the color distortion resulted by the temperature or the aging of the backlight module. Hence, a detailed description thereof is omitted. It is advantageous to do so because luminance of lights of different colors can be compensated. In addition, proper luminance compensation can be performed to lights of different colors since the aging rate of lights of different colors varies. Further, in another embodiment, the red light sensor 71, the green light sensor 72, and the blue light sensor 73 described in the above-mentioned embodiment can be integrated into a color sensor to save space and reduce the manufacturing costs.

Figure 7:
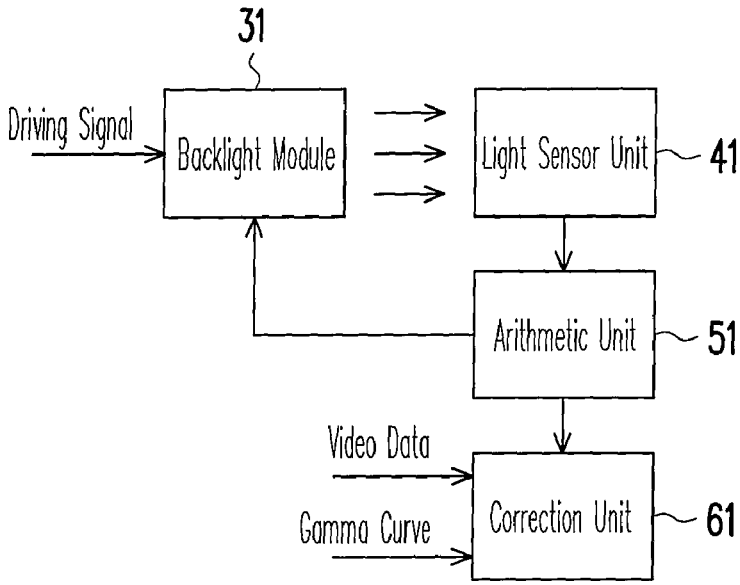
FIG. 7 is a schematic view illustrating a luminance compensation device for a backlight module according to the sixth embodiment of the present invention.

FIG. 7 is a schematic view illustrating a luminance compensation device of a backlight module according to the sixth embodiment of the present invention. Please refer to FIG. 7.

$$\begin{bmatrix} (V_{rr}-V_{r_dark})PWM(R), & (V_{rg}-V_{r_dark})PWM(G), & (V_{rb}-V_{r_dark})PWM(B) \\ (V_{gr}-V_{g_dark})PWM(R), & (V_{gg}-V_{g_dark})PWM(G), & (V_{gb}-V_{g_dark})PWM(B) \\ (V_{br}-V_{b_dark})PWM(R), & (V_{bg}-V_{b_dark})PWM(G), & (V_{bb}-V_{b_dark})PWM(B) \end{bmatrix}^{-1} \times \begin{bmatrix} V_m(R)-V_{r_dark} \\ V_m(G)-V_{g_dark} \\ V_m(B)-V_{b_dark} \end{bmatrix} = [\,S_1,\ S_2,\ S_3\,] \quad \text{Formula 3}$$

In the present embodiment, a backlight module 31, a light sensor unit 41, an arithmetic unit 51 and a correction unit 61 are identical to those described in the above-mentioned embodiment. Hence, a detailed description thereof is omitted. It should be noted that, in the present embodiment, after the arithmetic unit calculates the difference parameter, the arithmetic unit 51 outputs the difference parameter to the correction unit 61 and the backlight module 31. Both the correction unit 61 and the backlight module 31 can perform luminance compensation according to the difference parameter. It is advantageous to do so because using both the correction unit 61 and the backlight module 31 to perform double luminance compensation simultaneously to allow a more flexible adjustment for compensating the luminance distortion resulted by the temperature and the aging of the backlight module.

Figure 8:
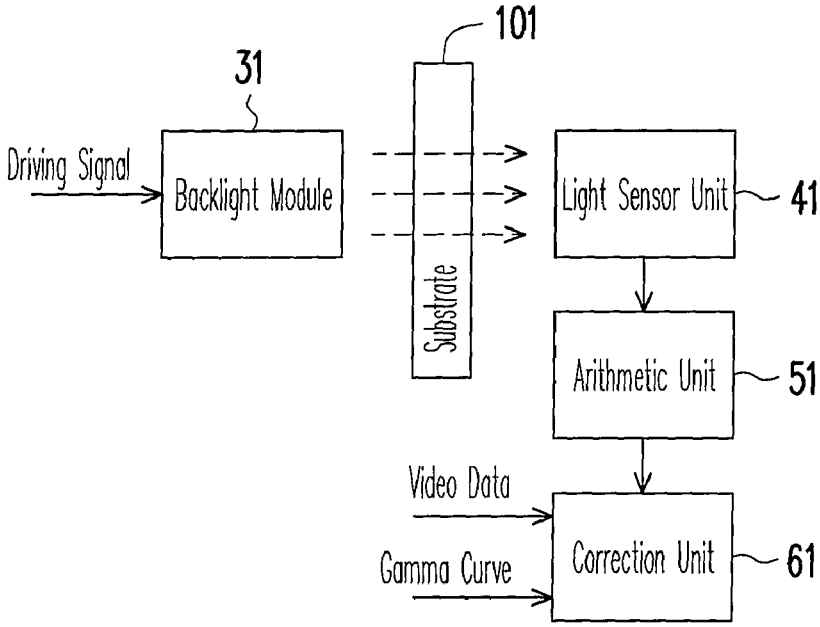
FIG. 8 is a schematic view illustrating a luminance compensation device for a backlight module according to the seventh embodiment of the present invention.

FIG. 8 is a schematic view illustrating a luminance compensation device of a backlight module according to the seventh embodiment of the present invention. Please refer to FIG. 8. In the present embodiment, a backlight module 31, a light sensor unit 41, an arithmetic unit 51 and a correction unit 61 are identical to those described in the above-mentioned embodiment. Hence, a detailed description thereof is omitted. It should be noted that, in the present embodiment, the light sensor unit 41 can be measured through a substrate 101. The substrate 101 is, for example, a polarizer, a glass substrate, a color filter, an alignment film, a liquid crystal panel, or an optical film. In other words, those ordinarily skilled in the art may dispose the light sensor unit 41 in any layer of the liquid crystal panel as required or dispose the light sensor unit 41 in any layer of the backlight module 31 as required. That is to say as long as the light sensor unit 41 can sense the light emitted by the backlight module 31, the luminance distortion and the color distortion resulted by the temperature or the aging of the backlight module 31 can be compensated according to the present invention and the teaching of the aforementioned embodiments. In addition, the preset luminance can be adjusted accordingly when the light sensor unit 41 is disposed at a different location to facilitate the calculation of the difference parameter. Hence, a detailed description thereof is omitted.

In summary, the embodiments of the present invention have at least the following advantages:

1. In the present embodiment, a light sensor unit is utilized to sense the light intensity of a backlight module. A difference parameter based on the sensed light intensity and a preset luminance is calculated. Subsequently, the gamma curve and/or the video data is adjusted according to the difference parameter in order to reduce the luminance distortion and the color distortion resulted by the temperature or the aging of the backlight module.
2. The correction unit is integrated into the display driving circuit or the correction unit and the arithmetic unit are integrated into the timing generator to greatly reduce the manufacturing costs.
3. A plurality of sensors or a color sensor is utilized to simultaneously compensate for the luminance distortion resulted by the temperature or the aging of the backlight module and the color distortion of light source of each color.
4. When the gamma curve and/or the video data are/is adjusted according to the difference parameter, the backlight module can perform multiple luminance compensation according to the difference parameter to allow a more flexible adjustment.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for compensating the luminance of a backlight module adapted for use in a display device that displays video data, comprising:

sensing a light intensity of a backlight module;

calculating a difference parameter based on the sensed light intensity and a preset luminance; and adjusting the video data according to the calculated difference parameter, wherein the method for calculating the difference parameters for red light, green light, and blue light further comprises:

calculating $S_1$, $S_2$, and $S_3$ using the formulae listed below, wherein $S_1$, $S_2$, and $S_3$ respectively represent the difference parameters for red light, green light and blue light, $V_m(R)$, $V_m(G)$, and $V_m(B)$ respectively represent light intensities of the red light, the green light, and the blue light sensed by a red light sensor, a green light sensor, and a blue light sensor, $V_{rr}$, $V_{gr}$, and $V_{br}$ respectively represent the light intensities of the red light, the green light, and the blue light sensed by a light sensor when a fixed driving current is continuously driving a red LED, $V_{rg}$, $V_{gg}$, and $V_{bg}$ respectively represent the light intensities of the red light, the green light, and the blue light sensed by the light sensor when the fixed driving current is continuously driving a green LED, $V_{rb}$, $V_{gb}$, and $V_{bb}$ respectively represent the light intensities of the red light, the green light, and the blue light sensed by the light sensor when the fixed driving current is continuously driving a blue LED, $V_{r_dark}$, $V_{g_dark}$, $V_{b_dark}$ respectively represent the light intensities of the red light, the green light, and the blue light sensed by the light sensor when the red LED, the green LED, and the blue LED are turned off, PWM(R), PWM(G), and PWM (B) respectively represent predetermined periods for lighting the red LED, the green LED, and the blue LED, and $$\begin{bmatrix} (V_{rr}-V_{r_dark})PWM(R), & (V_{rg}-V_{r_dark})PWM(G), & (V_{rb}-V_{r_dark})PWM(B), \\ (V_{gr}-V_{g_dark})PWM(R), & (V_{gg}-V_{g_dark})PWM(G), & (V_{gb}-V_{g_dark})PWM(B), \\ (V_{br}-V_{b_dark})PWM(R), & (V_{bg}-V_{b_dark})PWM(G), & (V_{bb}-V_{b_dark})PWM(B), \end{bmatrix}^{-1} \times \begin{bmatrix} V_m(R)-V_{r_dark} \\ V_m(G)-V_{g_dark} \\ V_m(B)-V_{b_dark} \end{bmatrix} = [S_1,\ S_2,\ S_3].$$

2. The method of claim 1, further comprising:

adjusting a gamma curve according to the difference parameter, wherein the gamma curve is used to convert or map the luminance or the color temperature of the video data.

3. The method of claim 1, further comprising:

adjusting the light intensity of the backlight module according to the difference parameter.

4. The method of claim 1, wherein the method for sensing the light intensity of the backlight module further comprises:

sensing the light intensity of the backlight module through a substrate.

5. The method of claim 1, wherein the method for calculating the difference parameter based on the sensed light intensity and the preset luminance further comprises:

calculating the difference parameter for the red light based on the light intensity for the red light and a preset luminance for the red light;

calculating the difference parameter for the green light based on the light intensity for green light and a preset luminance for the green light;

calculating the difference parameter for the blue light based on the light intensity for the blue light and a preset luminance for the blue light.

6. The method of claim 5, wherein the method for adjusting a gamma curve according to the difference parameter further comprises:

adjusting a red gamma curve according to the difference parameter for red light;

adjusting a green gamma curve according to the difference parameter for green light; and adjusting a blue gamma curve according to the difference parameter for blue light.

7. A luminance compensation device for a backlight module adapted for use in a display device that displays video data, comprising:

a light sensor unit used to sense a light intensity of the backlight module;

an arithmetic unit coupled to the light sensor unit and used for calculating a difference parameter based on the sensed light intensity and a preset luminance; and a correction unit coupled to the arithmetic unit and used for adjusting a gamma curve and/or the video data according to the difference parameter, wherein the gamma curve is used to convert or map the luminance or the color temperature of the video data, the arithmetic unit calculates $S_1$, $S_2$, and $S_3$ using the formulae listed below, $S_1$, $S_2$, and $S_3$ respectively represent difference parameters for red light, green light, and blue light, $V_m(R)$, $V_m(G)$, and $V_m(B)$ respectively represent light intensities of the red light, the green light, and the blue light sensed by a red light sensor, a green light sensor, and a blue light sensor, $V_{rr}$, $V_{gr}$, and $V_{br}$ respectively represent the light intensities of the red light, the green light, and the blue light sensed by a light sensor when a fixed driving current is continuously driving a red LED, $V_{rg}$, $V_{gg}$, and $V_{bg}$ respectively represent the light intensities of the red light, the green light, and the blue light sensed by the light sensor when the fixed driving current is continuously driving a green LED, $V_{rb}$, $V_{gb}$, and $V_{bb}$ respectively represent the light intensities of the red light, the green light, and the blue light sensed by the light sensor when the fixed driving current is continuously driving a blue LED, $V_{r_dark}$, $V_{g_dark}$, and $V_{b_dark}$ respectively represent the light intensities of the red light, the green light, and the blue light sensed by the light sensor when the red LED, the green LED, and the blue LED are turned off, PWM(R), PWM(G), and PWM(B) respectively represent predetermined periods for lighting the red LED, the green LED, and the blue LED, and:

$$\begin{bmatrix} (V_{rr}-V_{r_dark})PWM(R), & (V_{rg}-V_{r_dark})PWM(G), & (V_{rb}-V_{r_dark})PWM(B), \\ (V_{gr}-V_{g_dark})PWM(R), & (V_{gg}-V_{g_dark})PWM(G), & (V_{gb}-V_{g_dark})PWM(B), \\ (V_{br}-V_{b_dark})PWM(R), & (V_{bg}-V_{b_dark})PWM(G), & (V_{bb}-V_{b_dark})PWM(B), \end{bmatrix}^{-1} \times \begin{bmatrix} V_m(R)-V_{r_dark} \\ V_m(G)-V_{g_dark} \\ V_m(B)-V_{b_dark} \end{bmatrix} = [\,S_1,\ S_2,\ S_3\,].$$

8. The device of claim 7, wherein the correction unit further comprises:

a data mapping unit coupled to the arithmetic unit and used for adjusting the video data according to the difference parameter; and a gamma mapping unit coupled to the data mapping unit and used for adjusting the gamma curve according to the difference parameter.

9. The device of claim 7, wherein the light sensor unit further comprises:

a sensor used to sense the light intensity and output an electrical signal;

a signal conversion unit disposed between the arithmetic unit and the sensor by coupling and used for converting the electrical signal provided to the arithmetic unit.

10. The device of claim 7, wherein the backlight module adjusts the light intensity of the backlight module according to the difference parameter.

11. The device of claim 7, wherein the light sensor unit further senses the light intensity through a substrate.

12. The device of claim 7, wherein the light sensor unit further comprises:

the red light sensor used for sensing primarily the light intensity of the red light and outputting the light intensity of the red light to the arithmetic unit;

the green light sensor used for sensing primarily the light intensity of the green light and outputting the light intensity of the green light to the arithmetic unit; and the blue light sensor used for sensing primarily the light intensity of the blue light and outputting the light intensity of the blue light to the arithmetic unit.

13. The device of the claim 12, wherein the arithmetic unit calculates the difference parameter for the red light based on the light intensity of the red light and a preset luminance for the red light, the difference parameter for the green light based on the light intensity of the green light and a preset luminance for the green light, and the difference parameter for the blue light based on the light intensity of the blue light and a preset luminance for the blue light.

14. The device of claim 13, wherein the gamma mapping unit adjusts a red gamma curve according to the difference parameter for the red light, a green gamma curve according to the difference parameter for the green light, and a blue gamma curve according to the difference parameter for the blue light.

* * * * *